US007594620B2

(12) United States Patent
Abramson et al.

(10) Patent No.: US 7,594,620 B2
(45) Date of Patent: Sep. 29, 2009

(54) SHREDDER WITH REDUCED HAZARD POTENTIAL

(76) Inventors: Aron Abramson, 2025 E. 9th St., Brooklyn, NY (US) 11223; Charles Sued, 3360 Bedford Ave., Brooklyn, NY (US) 11210

( * ) Notice: Subject to any disclaimer, the term of this patent is extended or adjusted under 35 U.S.C. 154(b) by 744 days.

(21) Appl. No.: 11/326,274

(22) Filed: Jan. 5, 2006

(65) Prior Publication Data

US 2007/0290083 A1 Dec. 20, 2007

(51) Int. Cl.
*B02C 25/00* (2006.01)

(52) U.S. Cl. ..... 241/36; 241/37.5; 241/100

(58) Field of Classification Search ..... 241/30, 241/36, 37.5, 100, 236
See application file for complete search history.

(56) References Cited

U.S. PATENT DOCUMENTS

| | | | | |
|---|---|---|---|---|
| 2,308,578 | A | 1/1943 | White et al. | |
| 4,495,456 | A | 1/1985 | Vercillo et al. | |
| 4,609,155 | A * | 9/1986 | Garnier | 241/30 |
| 4,650,128 | A | 3/1987 | Goldhammer | |
| 5,035,366 | A | 7/1991 | Hashimoto et al. | |
| 5,054,695 | A | 10/1991 | Koornhof | |
| 5,167,374 | A | 12/1992 | Strohmeyer | |
| 5,474,241 | A | 12/1995 | Kennedy | |
| 5,494,229 | A * | 2/1996 | Rokos et al. | 241/15 |
| 5,772,129 | A * | 6/1998 | Nishio et al. | 241/30 |
| 5,839,675 | A | 11/1998 | Henreckson et al. | |
| 5,934,584 | A | 8/1999 | Schwelling | |
| 5,988,542 | A | 11/1999 | Henreckson et al. | |
| 6,079,645 | A | 6/2000 | Henreckson et al. | |
| 6,116,528 | A | 9/2000 | Schwelling | |
| D437,343 | S | 2/2001 | Ho | |
| D446,543 | S | 8/2001 | Ho | |
| D449,850 | S | 10/2001 | Ho | |
| D454,907 | S | 3/2002 | Ho | |
| D455,170 | S | 4/2002 | Ho | |
| D455,171 | S | 4/2002 | Ho | |
| 6,390,397 | B1 | 5/2002 | Ko | |
| 6,513,740 | B2 | 2/2003 | Ho | |
| 6,588,616 | B1 | 7/2003 | Ho | |
| D498,252 | S | 11/2004 | Lo | |
| D498,253 | S | 11/2004 | Lo | |
| D502,729 | S | 3/2005 | Lo | |
| D502,960 | S | 3/2005 | Lo | |
| D502,961 | S | 3/2005 | Lo | |
| 6,964,386 | B2 | 11/2005 | Ho | |
| 6,978,954 | B2 * | 12/2005 | Kroger et al. | 241/36 |
| 7,156,330 | B1 * | 1/2007 | Lo | 241/36 |
| 2003/0006330 | A1 | 1/2003 | Chang | |
| 2003/0042342 | A1 | 3/2003 | Kroger et al. | |
| 2004/0129810 | A1 | 7/2004 | Kasprowicz et al. | |
| 2005/0001080 | A1 | 1/2005 | Nemedi | |
| 2005/0236503 | A1 | 10/2005 | Matlin et al. | |
| 2005/0241998 | A1 | 11/2005 | Nemedi | |
| 2005/0274836 | A1 * | 12/2005 | Chang | 241/236 |

FOREIGN PATENT DOCUMENTS

| | | |
|---|---|---|
| CN | 3143129 | 3/2000 |

(Continued)

*Primary Examiner*—Jimmy T Nguyen
(74) *Attorney, Agent, or Firm*—Garcia-Zamor IP Law; Ruy M. Garcia-Zamor

(57) ABSTRACT

A shredder having a safety feature(s) that reduces potential safety hazards. The shredder preferably includes a timer mechanism in communication with a controller and adapted to automatically stop a plurality of shredder blades from operating if the blades have been activated for a predetermined period of time which preferably can be adjusted by a timer mechanism.

15 Claims, 3 Drawing Sheets

FOREIGN PATENT DOCUMENTS

| | | | |
|---|---|---|---|
| CN | 3149643 | | 5/2000 |
| CN | 3162622 | | 10/2000 |
| CN | 2438503 | | 7/2001 |
| CN | 3200986 | | 9/2001 |
| CN | 2467179 | | 12/2001 |
| CN | 3216733 | | 1/2002 |
| CN | 3221915 | | 2/2002 |
| CN | 3229342 | | 3/2002 |
| CN | 2541049 | | 3/2003 |
| CN | 2604251 | | 2/2004 |
| CN | 2638840 | | 9/2004 |
| CN | 3391961 | | 9/2004 |
| CN | 3393336 | | 9/2004 |
| CN | 3397934 | | 10/2004 |
| CN | 3420172 | | 1/2005 |
| CN | 3421634 | | 1/2005 |
| CN | 3426563 | | 2/2005 |
| CN | 2684931 | | 3/2005 |
| CN | 3429861 | | 3/2005 |
| CN | 2372104 | | 4/2005 |
| CN | 2372283 | | 4/2005 |
| CN | 2383583 | | 6/2005 |
| DE | 003819285 | A1 | 12/1989 |
| JP | 409070551 | A | 3/1997 |

* cited by examiner

SHREDDER WITH REDUCED HAZARD POTENTIAL

BACKGROUND

The present invention is generally directed to shredders and, more specifically, to a safety feature(s) for shredders.

Conventional shredders can have three operating modes. The first operating mode is an "off" mode in which the shredder blades are deactivated and no shredding of material can take place. The second operating mode is an "on" mode in which the shredder blades continually rotate to shred any material inserted into the shredder. The third operating mode is an "automatic" mode in which the shredder blades are automatically activated when the shredder detects that material is being inserted into the shredder. The "automatic" mode is advantageous in that material can be sporadically shredded without having to continually turn the shredder on and off. This makes it easy to open mail and immediately shred those items which are unneeded and may contain personal information.

However, the use of shredders in "automatic" mode can be problematic. The shredder can unintentionally be left in "automatic" mode after all shredding is completed since the lack of noise generated from shredder blade movement may result in a user forgetting that the shredder is not off. A shredder left in "automatic" mode for an extended period of time can present a safety hazard to the original or new users who are unaware that the shredder is only waiting to detect the insertion of material therein to activate its shredder blades. This can result in fingers or clothing being positioned near or inside the shredder slot while the shredder is not off which may lead to serious injury. The problem is further exacerbated when little children approach an unmonitored shredder left in "automatic" mode. Children are more prone to insertion of clothing and/or body parts into a shredder slot and are very likely to believe that the shredder is off. The impact of shredder blades on a young child can be devastating.

Safety hazards are also present in those shredders operating in "on" mode. These problems result from the shredder's ability to be left in "on" mode while unattended. This also creates a hazard to which children are especially susceptible.

It would be advantageous to provide a shredder that provides increased safety for users and others that come into contact with the shredder.

SUMMARY

Briefly speaking, one preferred embodiment of the present invention is directed to a shredder having automatically activated shredder blades and an associated safety feature. The shredder includes a shredder head housing which defines a slot that is adapted to receive material to be shredded. A plurality of shredder blades are disposed within the shredder head housing and are adapted to shred the material inserted into the slot. A selectable control is in communication with the shredder and has an activated state adapted to configure the shredder to automatically activate the plurality of shredder blades when the material is fed into the slot. A controller is disposed at least partially within the shredder head housing and, while the selectable control is in the activated state, is adapted to detect the material inserted into the shredder through the slot and, upon detection, activates the plurality of shredder blades to shred the detected material. A timer mechanism is in communication with the controller and is adapted to automatically selectable setting prevent the plurality of shredder blades from being activated if the selectable control has been in the activated state for a predetermined amount of time without any material being detected for shredding.

In another aspect, the present invention is directed to a method of shredding material. The method includes: providing a shredder defining at least one slot for receiving material, the shredder comprising a plurality of shredder blades adapted to shred the material inserted into the at least one slot; providing at least one sensor within the shredder that monitors the shredder to automatically detect the insertion of the material therein; automatically activating the plurality of shredder blades when the at least one sensor detects the insertion of the material into the shredder within a predetermined amount of time; and preventing the automatic activation of the plurality of shredder blades if the shredder has been monitored for the predetermined amount of time without the sensor detecting the insertion of material therein.

In another aspect, the present invention is directed to a shredder having automatically activated shredder blades and an associated safety feature. The shredder including a shredder head housing defining a slot adapted to receive material to be shredded. A plurality of shredder blades are disposed within the shredder head housing and are adapted to shred the material inserted into the slot. A selectable control is in communication with the shredder and has an activated state that is adapted to configure the shredder to automatically activate the plurality of shredder blades when the material is fed into the slot. A controller is disposed at least partially within the shredder head housing and, while the selectable control is in the activated state, is adapted to detect the material inserted into the shredder through the slot and, upon detection, activates the plurality of shredder blades to shred the detected material. A timer mechanism is in communication with the controller and is adapted to automatically prevent the plurality of shredder blades from being activated if the selectable control has been in the activated state for a predetermined amount of time without any material being detected for shredding. A shredder basket is adapted to engage the shredder head housing. A timer control is located on at least one of the shredder head housing and the shredder basket and is adapted to allow the predetermined amount of time to be adjusted. The timer control comprises a second selectable control.

In another aspect, the present invention is directed to a shredder having an associated safety feature including a shredder head housing that defines a slot which is adapted to receive material to be shredded. A plurality of shredder blades are disposed within the shredder head housing and are adapted to shred the material inserted into the slot. A selectable control is in communication with the shredder and has an activated state that is adapted to cause the shredder to continually activate the plurality of shredder blades. A controller is in communication with the selectable control and is located at least partially within the shredder head housing. The controller activates the plurality of shredder blades while the selectable control is in the activated state. A timer mechanism is in communication with the controller and is adapted to automatically stop the plurality of shredder blades from operating if the blades have been activated for a predetermined period of time.

In another aspect, the present invention is directed to a shredder having an associated safety feature including a shredder head housing that defines a slot which is adapted to receive material to be shredded. A plurality of shredder blades are disposed within the shredder head housing and are adapted to shred the material inserted into the slot. A selectable control is in communication with the shredder and has an activated state adapted to cause the shredder to continually activate the plurality of shredder blades. A controller is in communication with the selectable control and is located at least partially within the shredder head housing. The controller activates the plurality of shredder blades while the selectable control is in the activated state. The controller is further adapted to detect the material inserted into the shredder through the slot. A timer mechanism is in communication with the controller and is adapted to automatically prevent the operation of the plurality of shredder blades if the selectable control has been in the activated state for a predetermined amount of time without any material being detected for shredding.

In another aspect, the present invention is directed to a method of shredding material. The method includes the steps of: providing a shredder defining at least one slot for receiving material, the shredder comprising a plurality of shredder blades adapted to shred the material inserted into the at least one slot; providing at least one sensor within the shredder that monitors the shredder to automatically detect the insertion of the material therein; setting the shredder so that the plurality of shredder blades are continually activated; and stopping the operation of the plurality of shredder blades if the shredder blades are activated for a predetermined amount of time without the at least one sensor detecting the insertion of material therein.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
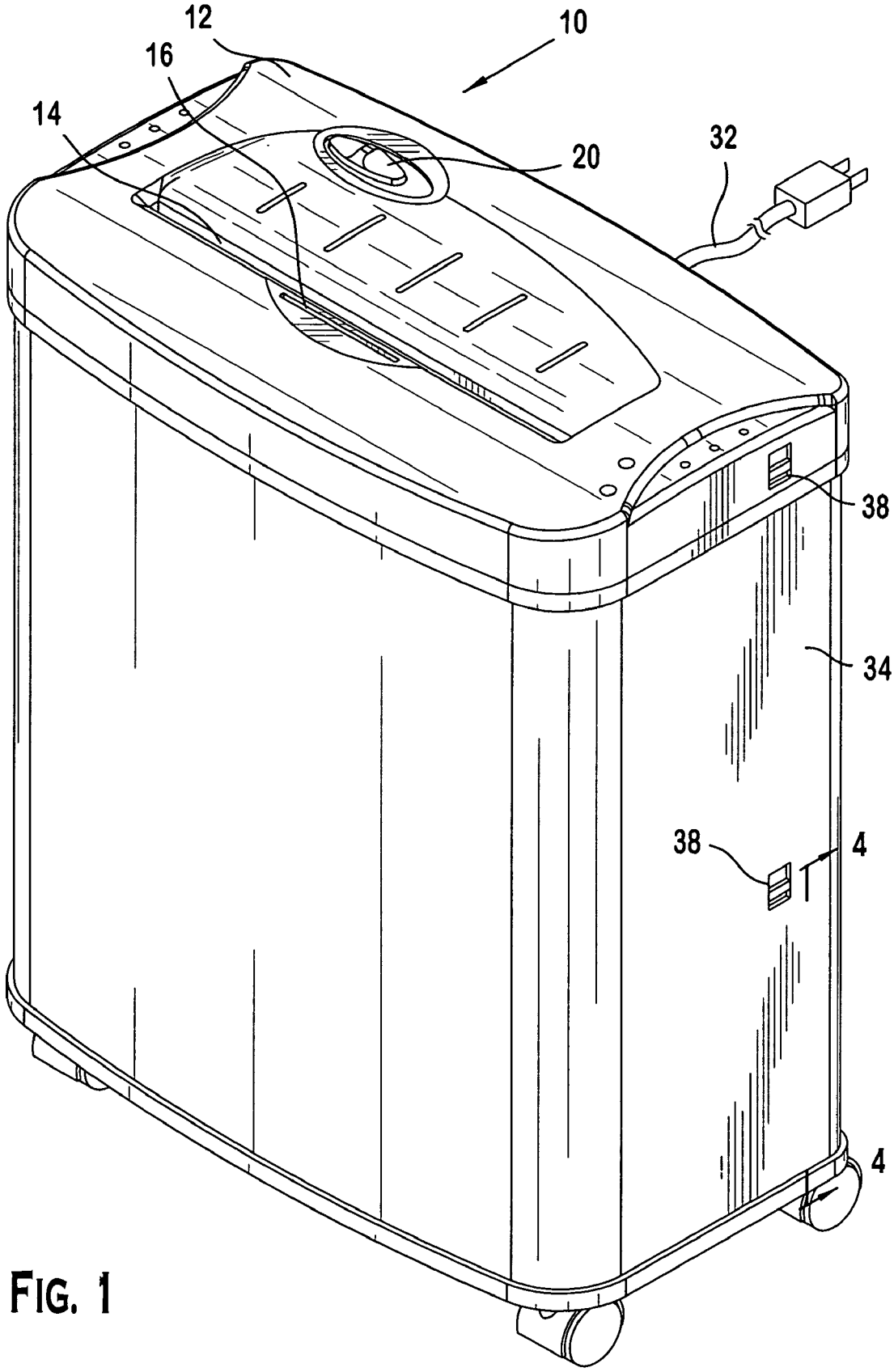
FIG. 1 is a perspective view of a shredder according to a preferred embodiment of the present invention.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "selectable control", as used in the claims and the corresponding portions of the specification, means "any one of a physical switch, a touch switch, a button, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-4, wherein like numerals indicate like elements throughout, there is shown a preferred embodiment of a shredder 10 having a safety feature according to the present invention. Briefly speaking, the shredder 10 may turn off when it has been in "automatic" mode for a predetermined amount of time without being fed material to shred. Alternatively, the shredder may turn off when it has been left in "on" mode for a predetermined period of time. Alternatively, the shredder may turn off when it has been left in "on" mode for a predetermined period of time without detecting any material to be shredded. Those of ordinary skill of the art will appreciate that the shredder of the present invention may include any one or all of the above functions without departing from the scope of the present invention. The shredder of the present invention need not have an "automatic" shred mode since separate aspects of this invention relate to safety features for shredders operating in "on" (or generally continuous) mode.

Referring to FIG. 1, one embodiment of the present invention includes a shredder with a shredder head housing 12. The shredder head housing 12 defines at least one slot 14, 16 for inserting material to be shredded. The primary slot 14 guides material to be shredded to shredder blades 18 that are driven by a motor 24 located in the shredder head housing 12. The plurality of shredder blades 18 are disposed within the shredder head housing 12 and are adapted to shred material inserted into one of the slots 14, 16. The first slot 14 is preferably used for paper documents and the second slot 16 is preferably used for more rigid documents, such as credit cards, compact discs, etc.

Referring still to FIG. 1, while the preferred shredder head housing 12 has a generally rectilinear shape, those of ordinary skill in the art will appreciate from this disclosure that the shredder head housing 12 can have any shape without departing from the scope of the present invention. The shredder head may also include a bin full indicator or other operational indicators. Shredder head handles are preferably located on the left and right lateral sides of the shredder head housing 12 to allow easy lifting of the shredder head from the shredder basket 34.

The shredder preferably receives power from an outlet via a power conduit, such as an electrical cord, 32. However, the shredder can be powered by batteries or any other suitable power source.

Figure 2:
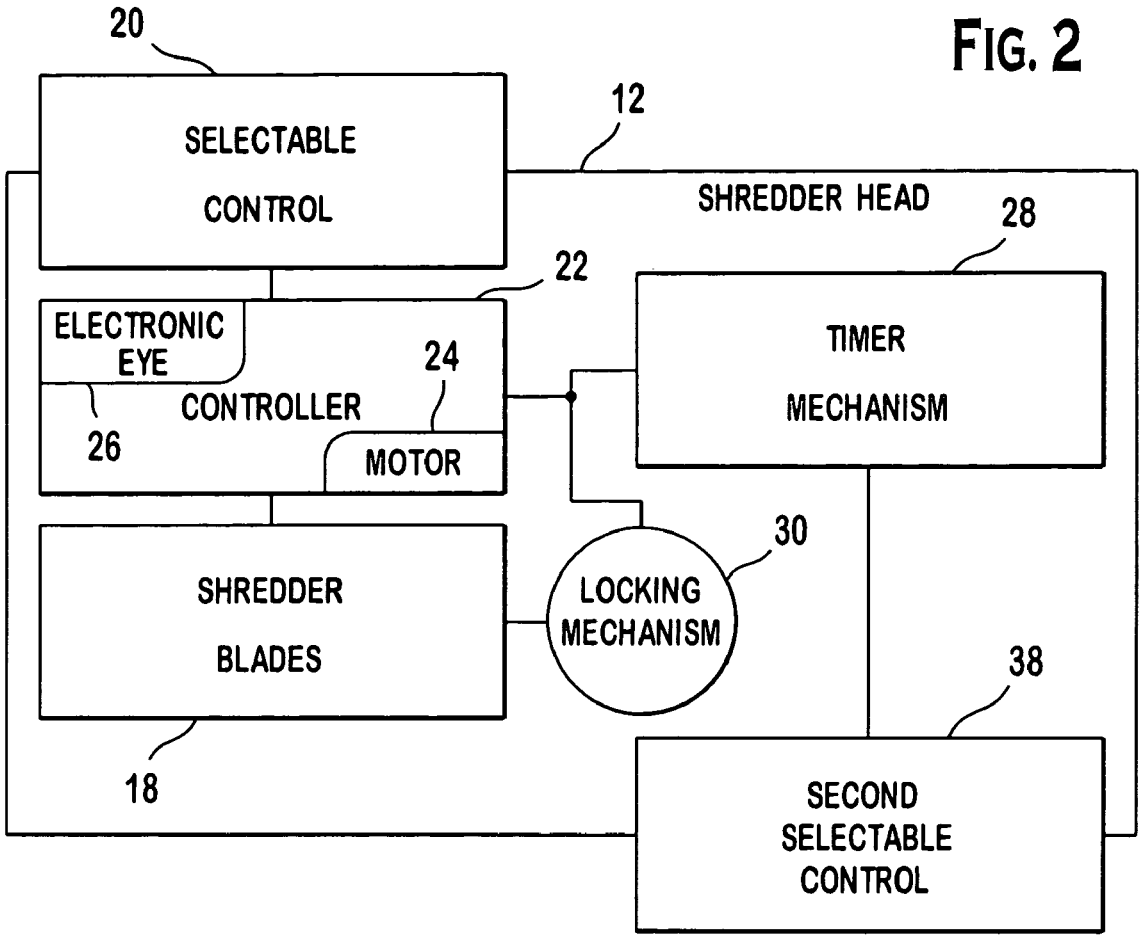
FIG. 2 is a block diagram of the shredder head of the shredder of FIG. 1.

Referring to FIGS. 1 and 2, the shredder 10 preferably includes a selectable control 20, such as a power switch, that is in communication with the shredder 10 and has an activated state adapted to configure the shredder 10 to automatically activate the plurality of shredder blades 18 when the material is fed into the slot 14, 16.

Figure 3:
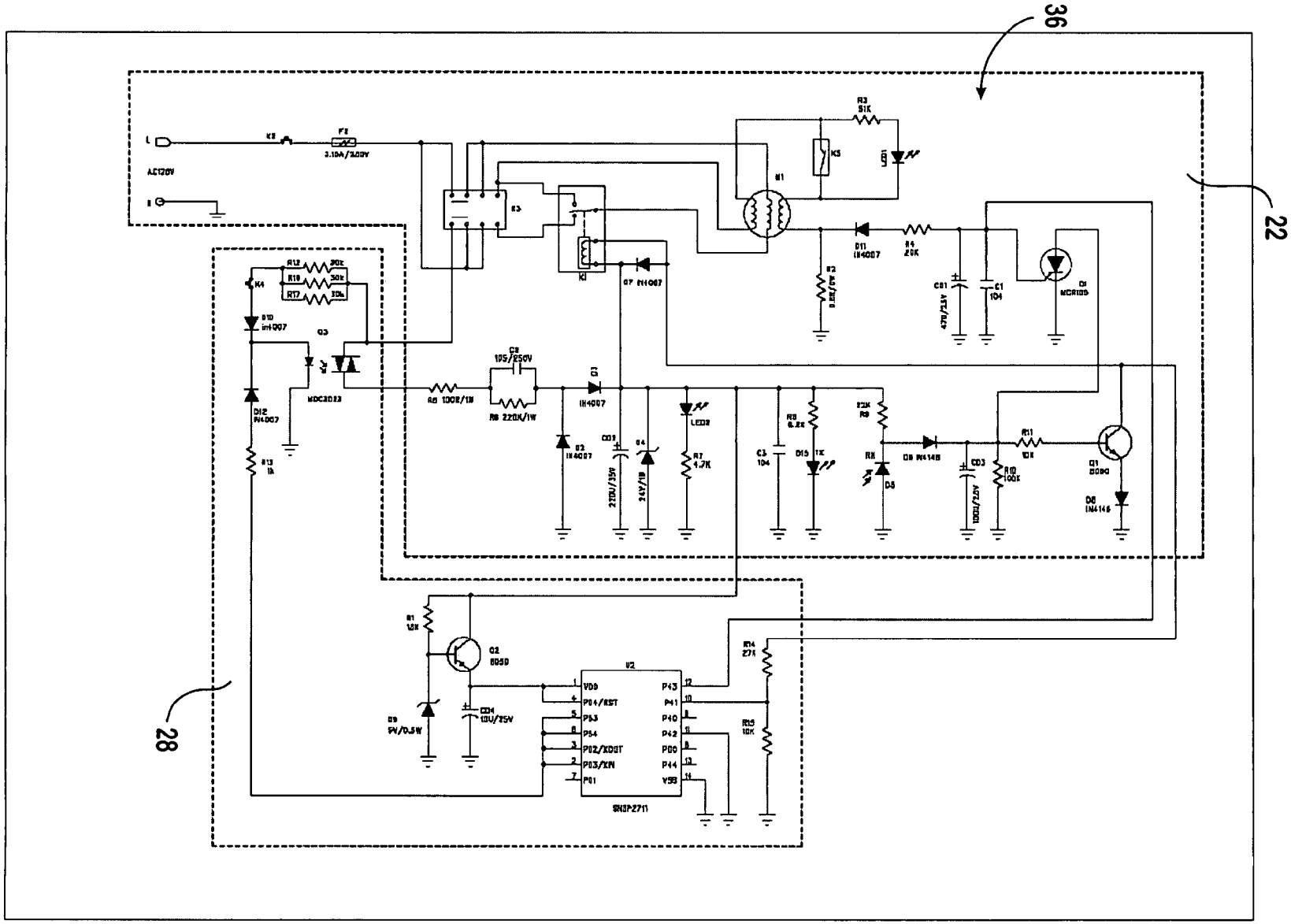
FIG. 3 is a circuit diagram of a controller and a timer mechanism of FIG. 2.

Referring to FIGS. 2 and 3, a controller 22 is preferably disposed at least partially within the shredder head housing 12. While the selectable controller 20 is in the activated state that puts the shredder 10 into "automatic" mode, the controller 20 detects any material inserted into the shredder 10 through a slot 14, 16. When the controller 20 detects inserted material, the controller 20 activates the plurality of shredder blades 18 to shred the detected material. The term "activated" as used with shredder blades means 18 that the blades are moved in whatever manner results in shredding (i.e., that the blades 18 are operating for shredding). Thus, the term "continually activated" means that the blades are continually operational as is normally the case when a shredder 10 is left in the "on" mode. It is preferred, that the shredder blades 18 rotate upon activation. However, vibratory movement, reciprocating movement, or any other suitable shredding movement can be used when the shredding blades 18 are activated.

The controller 22 may include a motor 24 disposed in the shredder head housing 12 and adapted to drive the plurality of shredder blades 18. Alternatively, the motor 22 may be considered separate from the controller 22 without departing from the scope of the present invention. The controller 22 may include one or more sensors, such as an electronic eye, 26 disposed within the shredder head housing 12 and adapted to detect the material inserted into a slot 14, 16. The electronic eye 26 is preferably, but not necessarily, formed by a diode pair comprising a light emitting diode and a light detecting diode. However, those of ordinary skill in the art will appreciate from this disclosure that any type of sensor(s) can be used to detect the insertion of material to be shredded without departing from the scope of the present invention.

Referring specifically to FIG. 3, the controller 22 preferably includes circuitry 36 that activates the motor 24 to drive the shredder blades 18 when the material is detected. Referring to FIGS. 2 and 3, the shredder 10 includes a timer mechanism 28 that is in communication with, or part of, the controller. Those of ordinary skill in the art will appreciate that the timer mechanism 28 may be integrated into the controller 22 without departing from the scope of the present invention. The timer mechanism 28 is adapted to automatically prevent the shredder blades 18 from being activated if the selectable control 20 has been in the activated state for a predetermined amount of time without any material being detected for shredding. It is preferred, but not necessary, that the predetermined amount of time is less than five minutes. It is more preferred that the predetermined amount of time is less than two minutes. It is more preferred still that the predetermined amount of time is less than one minute. By automatically preventing the shredding blades 18 from being activated after a predetermined amount of inactive time, the timer mechanism 28 reduces the chance of injury to people who may manipulate the shredder 10 while believing that it is off.

Figure 4:
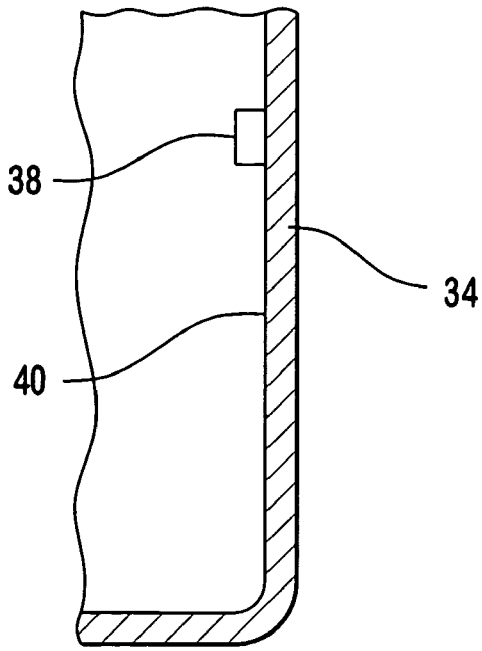
FIG. 4 is a partial cross-sectional view of the shredder basket of FIG. 1 as taken along the line 4-4 of FIG. 1.

The shredder 10 may also include a timer control, or second selectable control, 38 that is adapted to allow a user to vary the predetermined amount of time. Referring to FIG. 1, the second selectable control 38 may be located on the shredder head housing 12 or the associated basket 34. The timer control 38 allows users to set the predetermined amount of time as is most convenient for typical shredding operations. Referring to FIG. 4, the timer control 38 can be located on an inner surface 40 of the shredder basket 34 to increase the likelihood that only deliberate attempts to vary amount of time prior to shredder blade inactivation are successful.

Referring again to FIGS. 2 and 3, the timer mechanism 28 can be configured to provide a short circuit that deactivates the controller 22 and prevents the shredder blades 18 from being activated when the selectable control 20 has been in the activated state for the predetermined period of time without any material being detected for shredding. However, those of ordinary skill in the art will appreciate from this disclosure that any known method of deactivating the controller can be used. For example, the timer mechanism could shut down the power to the shredder without departing from the scope of the present invention.

Alternatively, the shredder 10 could include a locking mechanism 30 that physically locks the shredder blades and/or shredder blade drive shafts in position. Any other suitable locking mechanism or device that prevents material from being inserted into the shredder and reaching activated shredder blades 18 can be used without departing from the scope of the present invention. For example, the timer mechanism could lock out shredder access by causing solenoids to move a panel(s) into position to close off or seal the slots 14, 16 and prevent further shredding activity.

Once the timer mechanism 28 has deactivated the shredder 10, there are various ways that the shredder 10 can be reset for further shredding. After the timer mechanism 28 prevents the shredder blades 18 from activating, the timer mechanism 28 is adapted to again allow the activation of the shredder blades 18 (i.e., allow the shredder 10 to again operate in "automatic" mode after the timer mechanism 28 has already prevented the shredder blades 18 from being activated) if the selectable control 20 is at least temporarily deactivated (e.g., the power switch to the shredder 10 is turned off and then back into "automatic" mode). Alternatively, the timer mechanism 28 can be adapted to again allow the shredder blades 18 to be activated (i.e., to allow the shredder 10 to return to "automatic" mode) if the power conduit 32 is at least temporarily disconnected from a power source, such as an electric outlet. The timer mechanism 28 may also be adapted to require that both the power conduit 32 be disconnected from any power source and that the selectable control 20 is at least temporarily deactivated prior to allowing the shredder 10 to be placed in "automatic" mode.

Alternatively, shredder 10 of the present invention can be used to reduce hazards resulting from the use of the shredder 10 in the "on" mode. In this case, the selectable control 20 may be in communication with the shredder and may have an activated state adapted to cause the shredder to continually activate the plurality of shredder blades (i.e., may cause the shredder to be in the "on" mode). For this application, the controller 22 is in communication with the selectable control 20 and activates the plurality of shredder blades 18 while the selectable control 20 is in the activated state. The timer mechanism 28 is in communication with the controller 22 and is adapted to automatically stop the shredder blades 18 from operating if the blades have been activated for a predetermined period of time.

An alternate method for reducing the hazards resulting form the use of the shredder in the "on" mode follows. Instead of just turning off the shredder blades 18 once they have been activated for a predetermined amount of time, in this embodiment, the controller 22 monitors the shredder 10 to determine whether material has been inserted for shredding. The timer mechanism 28 causes the shredder blades to stop operating if a predetermined amount of time passes without any material being detected for shredding. This method of reducing hazards resulting from using a shredder in the "on" has the advantage of not causing the shredder to be deactivated during an extended shredding operation.

The present invention also includes multiple preferred methods of shredding material. The first preferred method includes the step of providing the shredder 10 which defines at least one slot 14, 16. The shredder 10 includes shredder blades 18 that are adapted to shred material inserted into the at least one slot 14, 16. At least one sensor, or electric eye, 26 is provided within the shredder 10 that monitors the shredder to automatically detect the insertion of material therein. The shredder blades automatically activate when the at least one sensor 26 detects the insertion of material into the shredder 10 within the predetermined amount of time. Activation of the shredder blades 18 is automatically prevented if the shredder 10 has been monitored for the predetermined amount of time without the sensor 26 detecting the insertion of material into the shredder.

The second preferred method of shredding material includes providing the shredder 10 which defines at least one slot 14, 16 for receiving material. The shredder 10 includes a plurality of shredder blades 18 adapted to shred the material inserted into the at least one slot 14, 16. At least one sensor 26 is provided within the shredder 10 that monitors the shredder 10 to automatically detect the insertion of the material therein. The shredder is set so that the plurality of shredder blades are continually activated. The operation of the plurality of shredder blades is stopped if the shredder blades are activated for a predetermined amount of time without the sensor detecting the insertion of material therein.

It is recognized by those skilled in the art that changes may be made to the above described methods and/or shredder 10 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A shredder having automatically activated shredder blades and an associated safety feature, comprising:

a shredder head housing defining a slot adapted to receive material to be shredded;

a plurality of shredder blades disposed within the shredder head housing and adapted to shred the material inserted into the slot;

a selectable control in communication with the shredder and having an activated state adapted to configure the shredder to automatically activate the plurality of shredder blades when the material is fed into the slot;

a controller disposed at least partially within the shredder head housing and, while the selectable control is in the activated state, adapted to detect the material inserted into the shredder through the slot and, upon detection, activates the plurality of shredder blades to shred the detected material;

a timer mechanism in communication with the controller and adapted to automatically preventing the plurality of shredder blades from being activated if the selectable control has been in the activated state for a predetermined amount of time without any material being detected for shredding, a shredder basket associated with the shredder head housing for receiving the shredder material; wherein the shredder head housing includes a timer control adapted to allow the predetermined amount of time to be adjusted; the timer control comprises a second selectable control located on an inner surface of the shredder basket.

2. The shredder of claim 1, wherein the shredder head housing defines a plurality of slots for receiving the material to be shredded.

3. The shredder of claim 1, wherein the timer mechanism is configured to provide a short circuit that deactivates the controller and prevents the plurality of shredder blades from being activated when the selectable control has been in the activated state for a predetermined amount of time without any material being detected for shredding.

4. The shredder of claim 1, wherein the timer mechanism activates a locking mechanism that prevents the activation of the plurality of shredder blades when the selectable control has been in the activated state for a predetermined amount of time without any material being detected for shredding.

5. The shredder of claim 1, wherein after the timer mechanism prevents the plurality of shredder blades from activating, the timer mechanism is adapted to allow the activation of the plurality of shredder blades if the selectable control is at least temporarily deactivated.

6. The shredder of claim 1, further including a power conduit extending from the shredder head housing and adapted to connect to a power source.

7. The shredder of claim 6, wherein after the timer mechanism prevents the activation of the plurality of shredder blades, the timer mechanism is adapted to allow the activation of the plurality of shredder blades if the power conduit is at least temporarily disconnected from the power source.

8. The shredder of claim 6, wherein after the timer mechanism prevents the activation of the plurality of shredder blades, the timer mechanism is adapted to allow the activation of the plurality of shredder blades if the selectable control is at least temporarily deactivated and the power conduit is at least temporarily disconnected from the power source.

9. The shredder of claim 3, wherein the controller further includes a motor disposed in the shredder head housing and adapted to drive the plurality of shredder blades.

10. The shredder of claim 9, wherein the controller includes an electronic eye sensor disposed within the shredder head housing adapted to detect the material inserted into the slot and circuitry that activates the motor to drive the shredder blades when the material is detected.

11. The shredder of claim 1, wherein the predetermined amount of time is less than five minutes.

12. The shredder of claim 1, wherein the predetermined amount of time is less than two minutes.

13. The shredder of claim 1, wherein the predetermined amount of time is less than one minute.

14. The shredder of claim 1, wherein the timer control comprises a second selectable control located on the shredder housing.

15. A shredder having automatically activated shredder blades and an associated safety feature, comprising:

a shredder head housing defining a slot adapted to receive material to be shredded;

a plurality of shredder blades disposed within the shredder head housing and adapted to shred the material inserted into the slot;

a selectable control in communication with the shredder and having an activated state adapted to configure the shredder to automatically activate the plurality of shredder blades when the material is fed into the slot;

a controller disposed at least partially within the shredder head housing and, while the selectable control is in the activated state, adapted to detect the material inserted into the shredder through the slot and, upon detection, activates the plurality of shredder blades to shred the detected material;

a timer mechanism in communication with the controller and adapted to automatically preventing the plurality of shredder blades from being activated if the selectable control has been in the activated state for a predetermined amount of time without any material being detected for shredding;

a shredder basket adapted to engage the shredder head housing for receiving the shredded material; and a timer control located on the shredder head housing and adapted to allow the predetermined amount of time to be adjusted, the timer control comprising a second selectable control, located on an inner surface of the shredder basket.

* * * * *